US008593491B2

(12) United States Patent
Bae et al.

(10) Patent No.: US 8,593,491 B2
(45) Date of Patent: Nov. 26, 2013

(54) APPLICATION OF VOLTAGE TO DATA LINES DURING VCOM TOGGLING

(75) Inventors: Hopil Bae, Sunnyvale, CA (US); Marduke Yousefpor, San Jose, CA (US)

(73) Assignee: Apple Inc., Cupertino, CA (US)

( * ) Notice: Subject to any disclaimer, the term of this patent is extended or adjusted under 35 U.S.C. 154(b) by 124 days.

(21) Appl. No.: 13/143,182

(22) PCT Filed: May 24, 2011

(86) PCT No.: PCT/US2011/037806
§ 371 (c)(1),
(2), (4) Date: Jul. 1, 2011

(87) PCT Pub. No.: WO2012/161701
PCT Pub. Date: Nov. 29, 2012

(65) Prior Publication Data

US 2012/0299970 A1 Nov. 29, 2012

(51) Int. Cl.
*G09G 5/10* (2006.01)

(52) U.S. Cl.
USPC ..... 345/690; 345/87; 345/694; 345/209; 345/210; 349/48; 349/143

(58) Field of Classification Search
USPC ..... 345/87–101, 690, 694, 209, 210; 349/48, 143
See application file for complete search history.

(56) References Cited

U.S. PATENT DOCUMENTS

| | | | |
|---|---|---|---|
| 5,483,261 | A | 1/1996 | Yasutake |
| 5,488,204 | A | 1/1996 | Mead et al. |
| 5,825,352 | A | 10/1998 | Bisset et al. |
| 5,835,079 | A | 11/1998 | Shieh |
| 5,880,411 | A | 3/1999 | Gillespie et al. |
| 6,188,391 | B1 | 2/2001 | Seely et al. |
| 6,310,610 | B1 | 10/2001 | Beaton et al. |

(Continued)

FOREIGN PATENT DOCUMENTS

| | | | |
|---|---|---|---|
| EP | 1 755 105 | A2 | 2/2007 |
| EP | 1 755 105 | A3 | 2/2007 |
| JP | 2000-163031 | A | 6/2000 |
| JP | 2002-342033 | A | 11/2002 |

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

(Continued)

*Primary Examiner* — Joseph Feild
*Assistant Examiner* — Linh N Hoffner
(74) *Attorney, Agent, or Firm* — Morrison & Foerster LLP

(57) ABSTRACT

With respect to liquid crystal display inversion schemes, a large change in voltage on a data line can affect the voltages on adjacent floating data lines due to capacitive coupling between data lines. The change in voltage on these floating data lines can be increased when the application of voltage to the data line occurs after a toggling operation of the Vcom, i.e., when a voltage applied to the Vcom changes the voltage on the Vcom from one polarity to an opposite polarity. Various embodiments of the present disclosure serve to eliminate or reduce the effects of Vcom voltage toggling on data line voltages by applying a voltage (e.g., a fixed voltage) to the data lines while the voltage on Vcom toggles.

18 Claims, 8 Drawing Sheets

(56) References Cited

U.S. PATENT DOCUMENTS

| | | | | |
|---|---|---|---|---|
| 6,323,846 | B1 | 11/2001 | Westerman et al. | |
| 6,441,758 | B1 * | 8/2002 | Koyama et al. | 341/136 |
| 6,690,387 | B2 | 2/2004 | Zimmerman et al. | |
| 7,015,894 | B2 | 3/2006 | Morohoshi | |
| 7,184,064 | B2 | 2/2007 | Zimmerman et al. | |
| 7,643,000 | B2 * | 1/2010 | Cho | 345/98 |
| 7,663,607 | B2 | 2/2010 | Hotelling et al. | |
| 8,264,454 | B2 * | 9/2012 | Kim et al. | 345/107 |
| 2004/0113923 | A1 * | 6/2004 | Ha et al. | 345/690 |
| 2004/0145583 | A1 | 7/2004 | Morita | |
| 2005/0099378 | A1 * | 5/2005 | Kim | 345/99 |
| 2006/0026521 | A1 | 2/2006 | Hotelling et al. | |
| 2006/0158412 | A1 * | 7/2006 | Morita | 345/94 |
| 2006/0197753 | A1 | 9/2006 | Hotelling | |
| 2006/0262130 | A1 * | 11/2006 | Kim et al. | 345/589 |
| 2006/0274028 | A1 | 12/2006 | Harada | |
| 2008/0074377 | A1 * | 3/2008 | Fujita | 345/96 |
| 2010/0195004 | A1 | 8/2010 | Hotelling | |
| 2010/0277406 | A1 * | 11/2010 | Choi et al. | 345/96 |
| 2011/0109605 | A1 | 5/2011 | Omori et al. | |

OTHER PUBLICATIONS

Rubine, D.H. (Dec. 1991). "The Automatic Recognition of Gestures," CMU-CS-91-202, Submitted in Partial Fulfillment of the Requirements for the Degree of Doctor of Philosophy in Computer Science at Carnegie Mellon University, 285 pages.

Rubine, D.H. (May 1992). "Combining Gestures and Direct Manipulation," CHI '92, pp. 659-660.

Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

International Search Report mailed Aug. 17, 2011, for PCT Application No. PCT/US2011/037806, filed May 24, 2011, four pages.

* cited by examiner

APPLICATION OF VOLTAGE TO DATA LINES DURING VCOM TOGGLING

FIELD OF THE DISCLOSURE

This relates generally to electrical shield systems in display screens, and more particularly, to electrical shield line systems for openings in common electrodes near data lines of display screens.

BACKGROUND

Display screens of various types of technologies, such as liquid crystal displays (LCDs), organic light emitting diode (OLED) displays, etc., can be used as screens or displays for a wide variety of electronic devices, including such consumer electronics as televisions, computers, and handheld devices (e.g., cellular telephones, audio and video players, gaming systems, and so forth). LCD devices, for example, typically provide a flat display in a relatively thin package that is suitable for use in a variety of electronic goods. In addition, LCD devices typically use less power than comparable display technologies, making them suitable for use in battery-powered devices or in other contexts where it is desirable to minimize power usage.

LCD devices typically include multiple picture elements (pixels) arranged in a matrix. The pixels may be driven by scanning line and data line circuitry to display an image on the display that can be periodically refreshed over multiple image frames such that a continuous image may be perceived by a user. Individual pixels of an LCD device can permit a variable amount light from a backlight to pass through the pixel based on the strength of an electric field applied to the liquid crystal material of the pixel. The electric field can be generated by a difference in potential of two electrodes, a common electrode and a pixel electrode. In some LCDs, such as electrically-controlled birefringence (ECB) LCDs, the liquid crystal can be in between the two electrodes. In other LCDs, such as in-plane switching (IPS) and fringe-field switching (FFS) LCDs, the two electrodes can be positioned on the same side of the liquid crystal. In many displays, the direction of the electric field generated by the two electrodes can be reversed periodically. For example, LCD displays can scan the pixels using various inversion schemes, in which the polarities of the voltages applied to the common electrodes and the pixel electrodes can be periodically switched, i.e., from positive to negative, or from negative to positive. As a result, the polarities of the voltages applied to various lines in a display panel, such as data lines used to charge the pixel electrodes to a target voltage, can be periodically switched according to the particular inversion scheme.

SUMMARY

With respect to liquid crystal display inversion schemes, a large change in voltage on a data line can affect the voltages on adjacent floating data lines due to capacitive coupling between data lines. The change in voltage on these floating data lines can be increased when the application of voltage to the data line occurs after a toggling operation of the Vcom, i.e., when a voltage applied to the Vcom changes the voltage on the Vcom from one polarity to an opposite polarity.

The following example embodiments serve to eliminate or reduce the effects of Vcom voltage toggling on data line voltages by applying a voltage (e.g., a fixed voltage) to each data line while the voltage on Vcom toggles to prevent changes to the data line voltages.

DETAILED DESCRIPTION

In the following description of exemplary embodiments, reference is made to the accompanying drawings in which it is shown by way of illustration specific embodiments of the disclosure. It is to be understood that other embodiments can be used and structural changes can be made without departing from the scope of the embodiments of the disclosure.

Furthermore, although embodiments of the disclosure may be described and illustrated herein in terms of logic performed within a display driver, host video driver, etc., it should be understood that embodiments of the disclosure are not so limited, but can also be performed within a display subassembly, liquid crystal display driver chip, or within another module in any combination of software, firmware, and/or hardware.

With respect to liquid crystal display inversion schemes, a large change in voltage on a data line can affect the voltages on adjacent floating data lines due to capacitive coupling between data lines. The change in voltage on these floating data lines can be increased when the application of voltage to the data line occurs after a toggling operation of the Vcom, i.e., when a voltage applied to the Vcom changes the voltage on the Vcom from one polarity to an opposite polarity. Various embodiments of the present disclosure serve to eliminate or reduce the effects of Vcom voltage toggling on data line voltages by applying a fixed voltage to the data lines while the voltage on Vcom toggles.

Figure 1C:
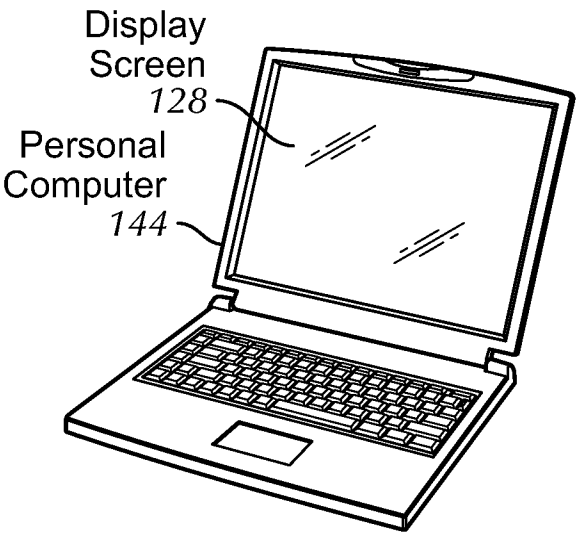
FIG. 1C illustrates an example personal computer according to embodiments of the disclosure.
Figure 1B:
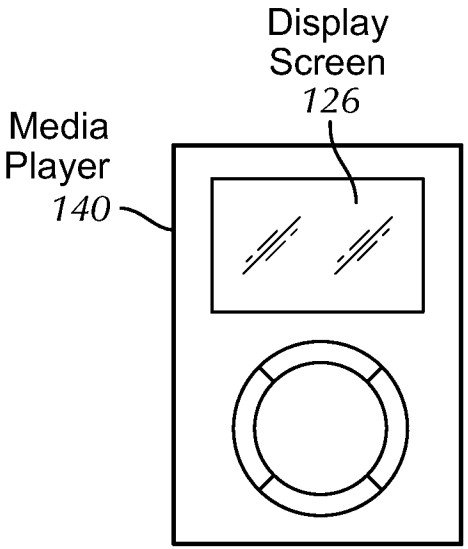
FIG. 1B illustrates an example digital media player according to embodiments of the disclosure.
Figure 1A:
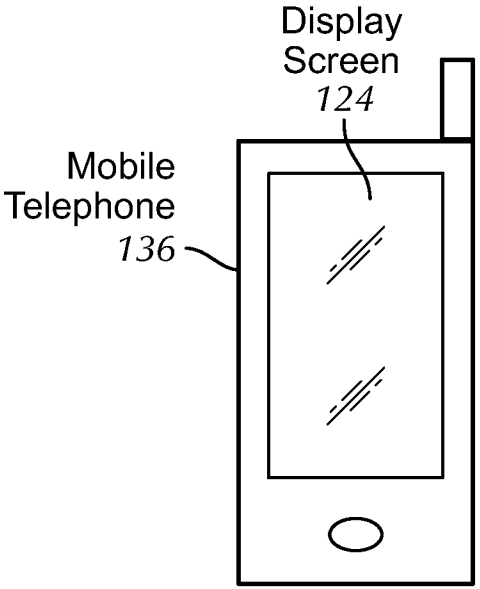
FIG. 1A illustrates an example mobile telephone according to embodiments of the disclosure.
Figure 1D:
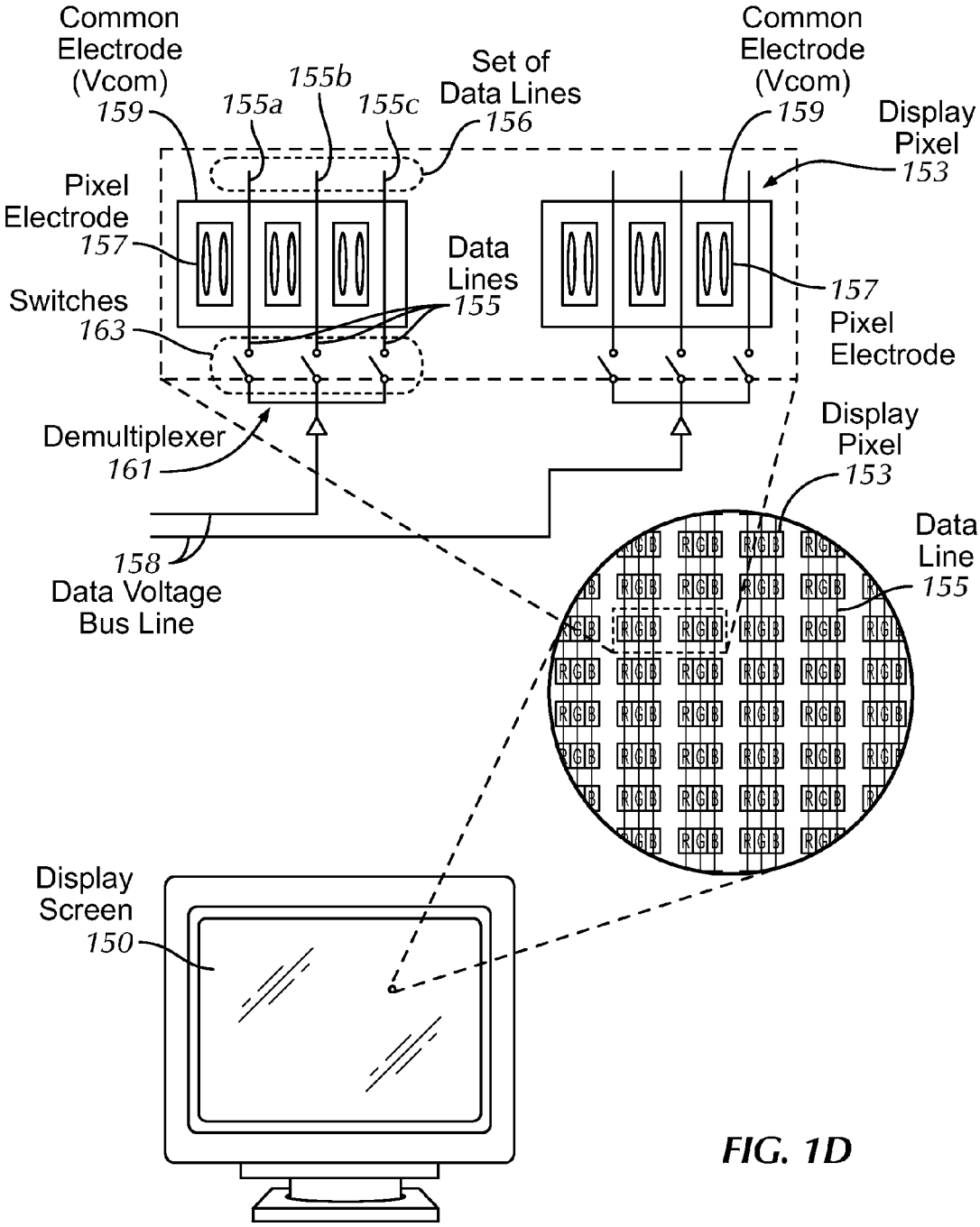
FIG. 1D illustrates an example display screen according to embodiments of the disclosure.

FIGS. 1A-1D show example systems in which display screens (which can be part of touch screens) according to embodiments of the disclosure may be implemented. FIG. 1A illustrates an example mobile telephone 136 that includes a display screen 124. FIG. 1B illustrates an example digital media player 140 that includes a display screen 126. FIG. 1C illustrates an example personal computer 144 that includes a display screen 128. FIG. 1D illustrates an example display screen 150, such as a stand-alone display. In some embodiments, display screens 124, 126, 128, and 150 can be touch screens in which touch sensing circuitry can be integrated into the display pixels. Touch sensing can be based on, for example, self capacitance or mutual capacitance, or another touch sensing technology. In some embodiments, a touch screen can be multi-touch, single touch, projection scan, full-imaging multi-touch, or any capacitive touch.

FIG. 1D illustrates some details of an example display screen 150. FIG. 1D includes a magnified view of display screen 150 that shows multiple display pixels 153, each of which can include multiple display sub-pixels, such as red (R), green (G), and blue (B) sub-pixels in an RGB display, for example. Data lines 155 can run vertically through display screen 150, such that a set 156 of three data lines (an R data line 155*a*, a G data line 155*b*, and a B data line 155*c*) can pass through an entire column of display pixels (e.g., vertical line of display pixels).

FIG. 1D also includes a magnified view of two of the display pixels 153, which illustrates that each display pixel can include pixel electrodes 157, each of which can correspond to one of the sub-pixels, for example. Each display pixel can include a common electrode (Vcom) 159 that can be used in conjunction with pixel electrodes 157 to create an electrical potential across a pixel material (not shown). Varying the electrical potential across the pixel material can correspondingly vary an amount of light emanating from the sub-pixel. In some embodiments, for example, the pixel material can be liquid crystal. A common electrode voltage can be applied to a Vcom 159 of a display pixel, and a data voltage can be applied to a pixel electrode 157 of a sub-pixel of the display pixel through the corresponding data line 155. A voltage difference between the common electrode voltage applied to Vcom 159 and the data voltage applied to pixel electrode 157 can create the electrical potential through the liquid crystal of the sub-pixel. The electrical potential can generate an electric field through the liquid crystal, which can cause inclination of the liquid crystal molecules to allow polarized light from a backlight (not shown) to emanate from the sub-pixel with a luminance that depends on the strength of the electric field (which can depend on the voltage difference between the applied common electrode voltage and data voltage). In other embodiments, the pixel material can include, for example, a light-emitting material, such as can be used in organic light emitting diode (OLED) displays.

In this example embodiment, the three data lines 155 in each set 156 can be operated sequentially. For example, a display driver or host video driver (not shown) can multiplex an R data voltage, a G data voltage, and a B data voltage onto a single data voltage bus line 158 in a particular sequence, and then a demultiplexer 161 in the border region of the display can demultiplex the R, G, and B data voltages to apply the data voltages to data lines 155*a*, 155*b*, and 155*c* in the particular sequence. Each demultiplexer 161 can include three switches 163 that can open and close according to the particular sequence of sub-pixel charging for the display pixel. In an R-G-B sequence, for example, data voltages can be multiplexed onto data voltage bus line 158 such that R data voltage is applied to R data line 155*a* during a first time period, G data voltage is applied to G data line 155*b* during a second time period, and B data voltage is applied to B data line 155*c* during a third time period. Demultiplexer 161 can demultiplex the data voltages in the particular sequence by closing switch 163 associated with R data line 155*a* during the first time period when R data voltage is being applied to data voltage bus line 158, while keeping the green and blue switches open such that G data line 155*b* and B data line 155*c* are at a floating potential during the application of the R data voltage to the R data line. In this way, for example, the red data voltage can be applied to the pixel electrode of the red sub-pixel during the first time period. During the second time period, when G data voltage is being applied to G data line 155*b*, demultiplexer 161 can open the red switch 163, close the green switch 163, and keep the blue switch 163 open, thus applying the G data voltage to the G data line, while the R data line and B data line are floating. Likewise, the B data voltage can be applied during the third time period, while the G data line and the R data line are floating.

As will be described in more detail below with respect to example embodiments, applying a data voltage to a data line can affect the voltages on surrounding, floating data lines. Moreover, the effect on these floating data lines can be increased when the application of voltage to the data line occurs after a toggling operation of the Vcom, i.e., when a voltage applied to the Vcom changes the polarity of voltage on Vcom to an opposite polarity. In some cases, the effect on the voltages of floating data lines can affect the luminance of the sub-pixels corresponding to the affected data lines, causing the sub-pixels to appear brighter or darker than intended. The resulting increase or decrease in sub-pixel luminance can be detectable as a visual artifact in some displays.

In some embodiments, thin film transistors (TFTs) can be used to address display pixels, such as display pixels 153, by scanning lines of display pixels (e.g., rows of display pixels) in a particular order. When each line is updated during the scan of the display, data voltages corresponding to each display pixel in the updated line can be applied to the set of data lines of the display pixel through the demuxing procedure described above, for example.

Figure 2:
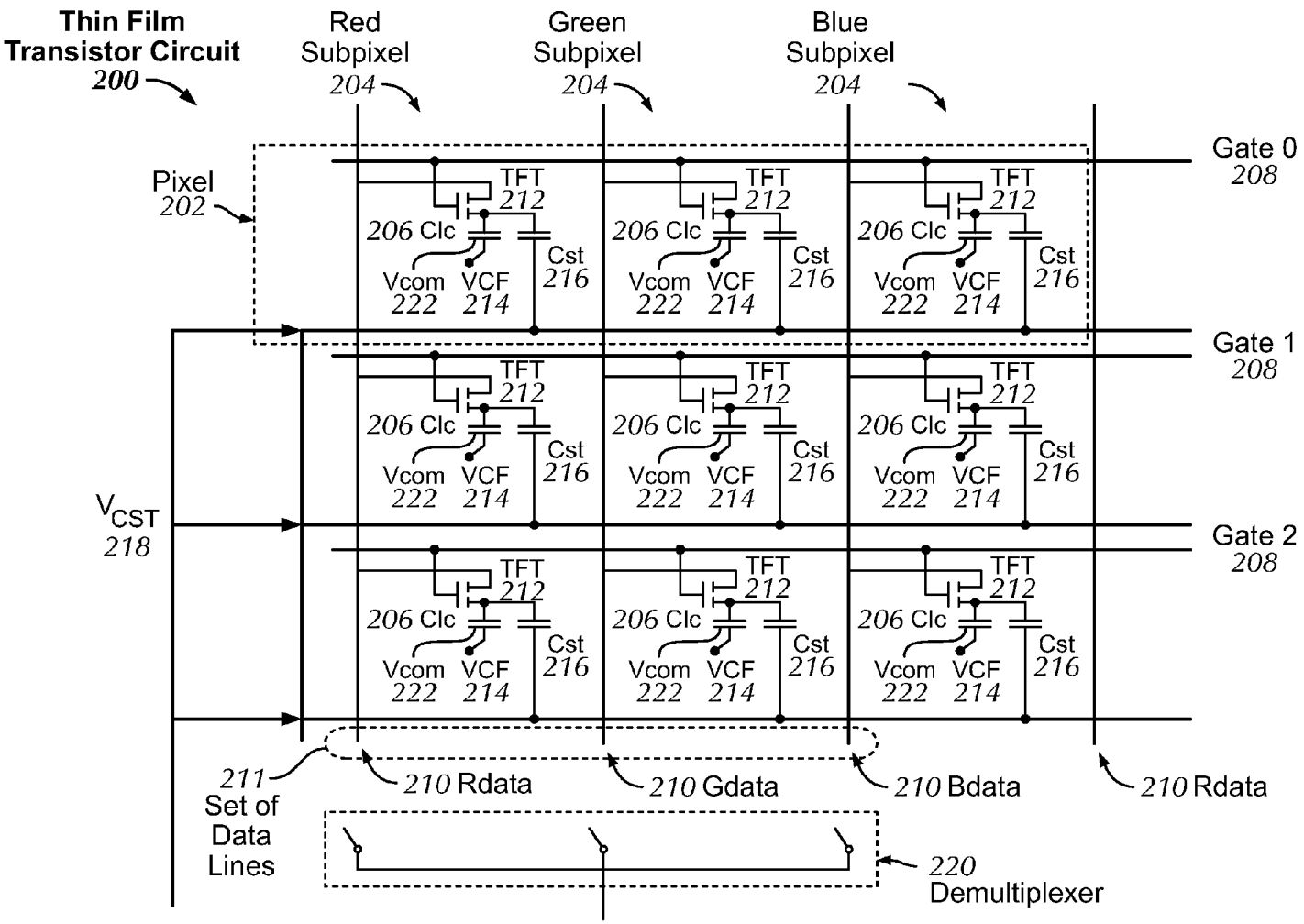
FIG. 2 illustrates an example thin film transistors (TFT) circuit according to embodiments of the disclosure.

FIG. 2 illustrates a portion of an exemplary TFT circuit 200 according to embodiments of the present disclosure. As shown by the figure, the thin film transistor circuit 200 can include multiple pixels 202 arranged into rows, or scan lines, with each pixel 202 containing a set of color sub-pixels 104 (red, green, and blue, respectively). It is understood that a plurality of pixels can be disposed adjacent each other to form a row of the display. Each color reproducible by the liquid crystal display can therefore be a combination of three levels of light emitted from a particular set of color sub-pixels 204.

Color sub-pixels may be addressed using the thin film transistor circuit's 200 array of scan lines (called gate lines 208) and data lines 210. Gate lines 208 and data lines 210 formed in the horizontal (row) and vertical (column) directions, respectively, and each column of display pixels can include a set 211 of data lines including an R data line, a G data line, and a B data line. Each sub-pixel may include a pixel TFT 212 provided at the respective intersection of one of the gate lines 208 and one of the data lines 210. A row of sub-pixels may be addressed by applying a gate signal on the row's gate line 208 (to turn on the pixel TFTs of the row), and by applying voltages on the data lines 210 corresponding to the amount of emitted light desired for each sub-pixel in the row. The voltage level of each data line 210 may be stored in a storage capacitor 216 in each sub-pixel to maintain the desired voltage level across the two electrodes associated with the liquid crystal capacitor 206 relative to a voltage source 214 (denoted here as $V_{cf}$). A voltage $V_{cf}$ may be applied to the counter electrode (common electrode Vcom) 222 forming one plate of the liquid crystal capacitance with the other plate formed by a pixel electrode associated with each sub-pixel. One plate of each of the storage capacitors 216 may be connected to a common voltage source Cst along line 218. The voltage difference across the common electrode and pixel electrode can generate an electric field through the liquid crystal that can affect the luminance of the sub-pixel as explained above.

Applying a voltage to a sub-pixel's data line can charge the sub-pixel (e.g., the pixel electrode of the sub-pixel) to the voltage level of the applied voltage. Demultiplexer 220 in the border region of the display can be used to apply the data voltages to the desired data line. For example, demultiplexer 220 can apply data voltages to the R data line, the G data line, and the B data line in a set 211 in a particular sequence, as described above with reference to FIG. 1D. Therefore, while a voltage can be applied to one data line (e.g., red), the other data lines (e.g., green and blue) in the pixel can be floating. However, applying a voltage to one data line can affect the voltage on floating data lines, for example, because a capacitance existing between data lines can allow voltage changes on one data line to be coupled to other data lines. This capacitive coupling can change the voltage on the floating data lines, which can make the sub-pixels corresponding to the floating data lines appear either brighter or darker depending on whether the voltage change on the charging data line is in the same direction or opposite direction, respectively, as the polarity of the floating data line voltage. The amount of voltage change on the floating data line can depend on the amount of the voltage change on the charging sub-pixel's data line.

In addition to capacitive coupling between data lines, a mutual capacitance may also form between Vcom and the data lines. In this regard, toggling the voltage on Vcom from one polarity to an opposite polarity may also affect the voltage on a subsequently charged data line. This effect can, in turn, change the voltage on a floating data line and can impact the appearance of visual artifacts on the floating data line's corresponding sub-pixel. This chain of effects may occur because the data lines in the display panel are floating when Vcom toggles. For example, when the voltage on Vcom toggles from a negative polarity to a positive polarity, the positive voltage change on Vcom can increase the voltage on the floating data lines to an adjusted voltage value. When a target voltage with a negative polarity is later applied to one of these floating data lines, the voltage on the data line decreases from this increased adjusted voltage to its target value. Because the change in voltage on Vcom increased the initial voltage on the data line, the subsequent charging of the data line to its target value can result in a large change in voltage on the data line. This large change in voltage can, in turn, affect the voltage on adjacent floating data lines.

Figure 3A:
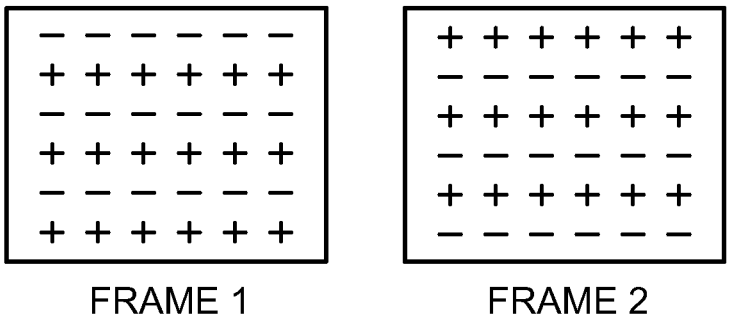
FIG. 3A illustrates an example single-line inversion scheme according to embodiments of the disclosure.
Figure 3B:
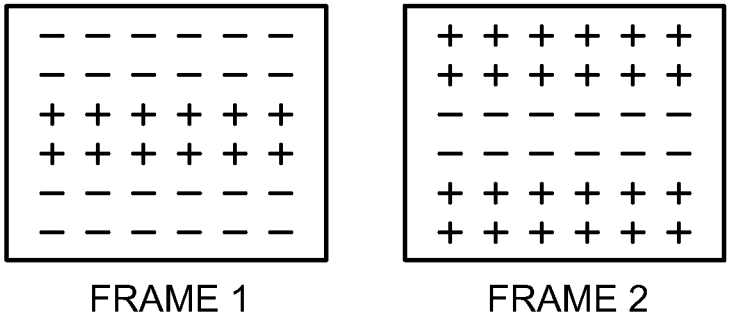
FIG. 3B illustrates an example two-line inversion scheme according to embodiments of the disclosure.
Figure 3C:
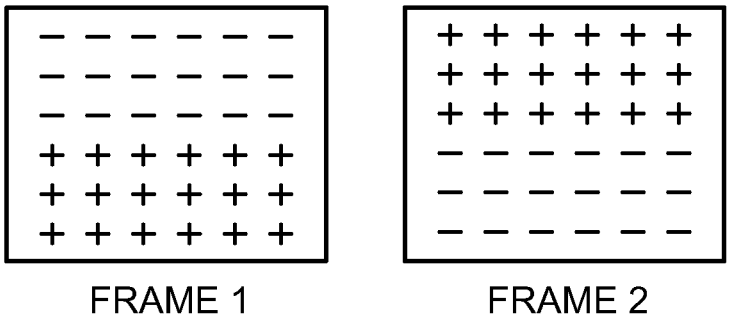
FIG. 3C illustrates an example three-line inversion scheme according to embodiments of the disclosure.

As explained above, the voltage on a data line can change when the voltage on Vcom toggles from one polarity to an opposite polarity. Whether the voltage on Vcom toggles can depend on the inversion scheme used. In line inversion, for example, the polarity of the voltage applied to the data lines during the scan of one row can be different from the polarity of the voltage applied during the scan of another row in the same frame. In single-line inversion, the polarity of the voltage on each sub-pixel can be the same for all sub-pixels in the same row, and this polarity can alternate from row to row. This configuration is illustrated in FIG. 3A. In the next frame, the polarity of the voltage on the data line can be reversed. As is known in the art, other line inversion schemes, including two-line inversion illustrated in FIG. 3B, and three-line inversion illustrated in FIG. 3C, can operate according to similar principles. In two-line inversion, every block of two rows can have the same polarity. In three-line inversion, every block of three rows can have the same polarity.

In each of these line inversion schemes, the voltage on Vcom can toggle as the polarity of the voltage applied to the data line switches. However, the voltage on Vcom toggles in a direction opposite to the polarity change of the voltage on the data lines. For example, when the polarity of the voltage on the data lines switches from positive to negative, the voltage on Vcom can toggle from negative to positive. When the polarity of the voltage on the data lines switches from negative to positive, the voltage on Vcom can toggle from positive to negative.

The toggling of the voltage on Vcom can affect the voltage on the data lines as will now be explained with reference to the example circuit shown in FIG. 2 and the graph shown in FIG. 4. In this example, the data lines are scanned according to the example single-line inversion scheme illustrated in FIG. 3A. As explained above, a row of sub-pixels may be addressed by applying a gate signal on the row's gate line to switch on the pixel TFT and connecting the data lines to the sub-pixels in the row. Once these data lines are connected to the sub-pixels, the voltages on the data lines can be updated. After the voltages on the data lines are updated, a gate signal can be applied to switch off the pixel TFT of the current row. A gate signal can then be applied to the next row of sub-pixels to switch on the pixel TFTs.

Figure 4:
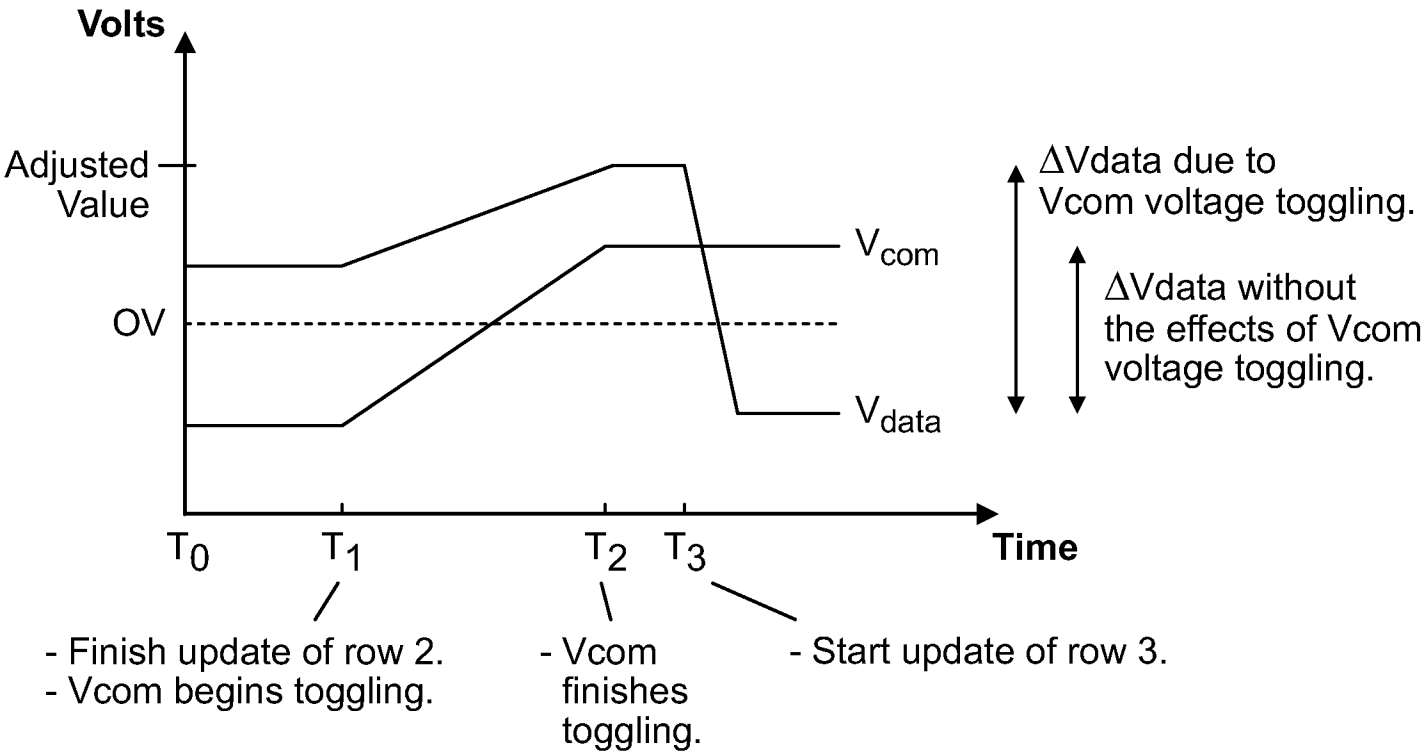
FIG. 4 illustrates the change in voltage on a data line and Vcom when the data line voltages are not held at a fixed value when the voltage on Vcom toggles according to embodiments of the disclosure.

With regard to FIGS. 3A and 4, when a gate signal is applied to switch on the second row between times T0 and T1, a positive voltage can be applied to each data line 210. While these data lines are updated, the voltage on Vcom 222 can have a negative polarity. At time T1, the voltage on the data lines in the second row have finished updating.

After these data lines are updated, a gate signal can be applied to switch off the pixel TFT of the second row which can place the rows in a floating state. The voltage on Vcom can toggle from a negative polarity to a positive polarity between times T1 and T2 as illustrated in FIG. 4. Because the data lines are floating when the voltage on Vcom toggles, the increase in the voltage on Vcom can also increase the voltage level on the floating data lines to an "Adjusted Value." This is represented by the increase in $V_{data}$ between times T1 and T2.

After Vcom has finished toggling at time T2, a gate signal can be applied to the third row at time T3 to begin the update of the data lines. As illustrated, a negative target voltage can be applied to any one of these data lines. During this time, the voltage on Vcom can have a positive polarity. When a data line is updated, the voltage on the data line drops from its "Adjusted Value" to its new negative target voltage. This change in voltage is represented by "$\Delta V_{data}$ due to Vcom voltage toggling."

If the voltage on the data line had not increased between times T1 and T2 due to Vcom toggling, the change in voltage on the data line at time T3 would instead be represented by "$\Delta V_{data}$ without the effects of Vcom voltage toggling." As illustrated, "$\Delta V_{data}$ due to Vcom voltage toggling" can be larger than "$\Delta V_{data}$ without the effects of Vcom voltage toggling" because $V_{data}$ falls from a higher adjusted value. This large change in voltage on the data line can impact the voltage on adjacent floating data lines which, in turn, can affect the appearance of visual artifacts. The following example embodiments serve to eliminate or reduce the effects of Vcom voltage toggling on data line voltages.

In one example embodiment, a fixed voltage can be applied to each data line while the voltage on Vcom toggles. By applying a fixed voltage to the data lines, the data lines are no longer floating. As such, a change in the voltage on Vcom may not affect the voltage on the data lines.

Figure 5:
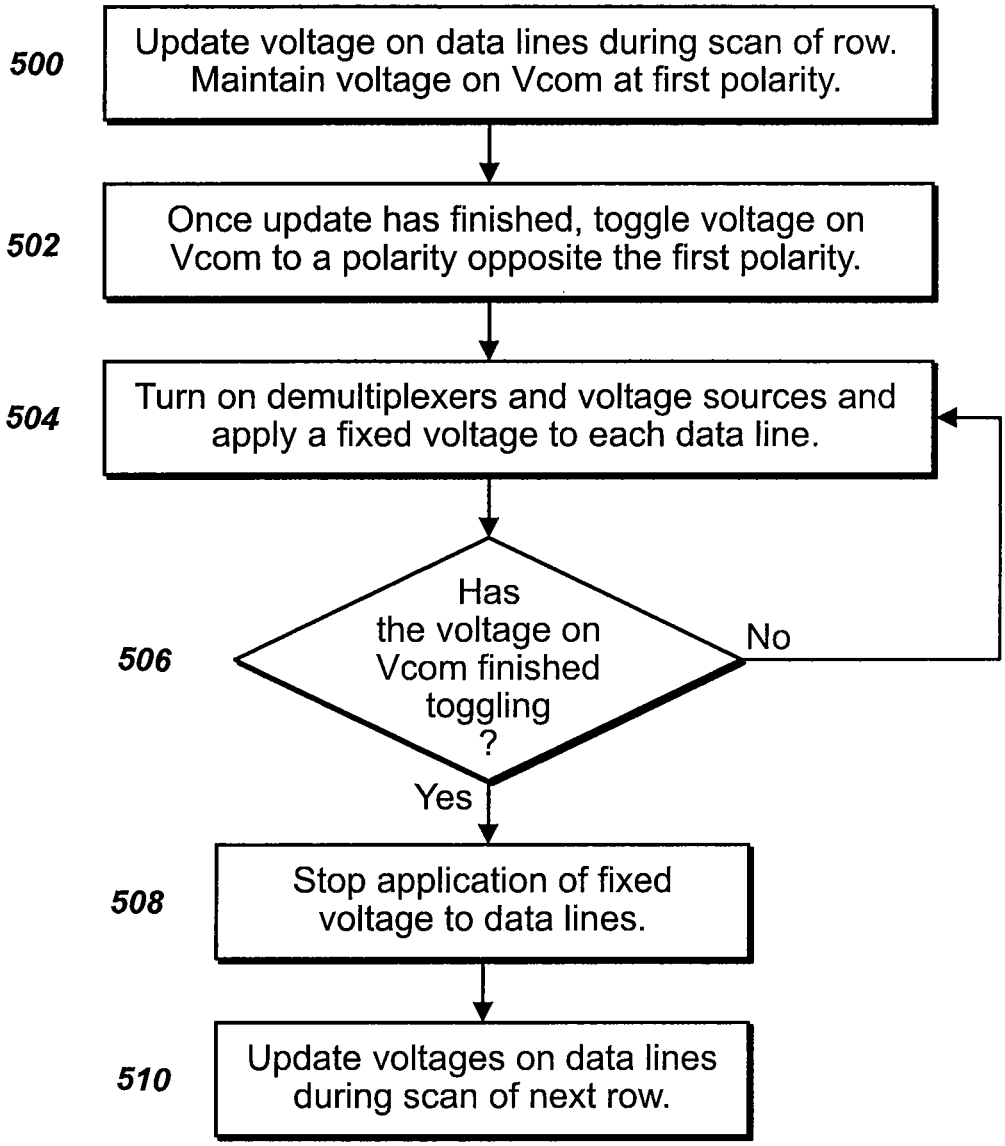
FIG. 5 illustrates a flowchart that holds the voltage on the data lines at a fixed value when the voltage on Vcom toggles according to embodiments of the disclosure.

This example embodiment is illustrated in the flowchart of FIG. 5. Starting at step 500, the voltage on the data lines can be updated during a scan of a row. During this time, the voltage on Vcom can be set to a first polarity. Once these data lines have finished updating at step 502, the data lines are disconnected from their respective voltage sources, and the voltage on Vcom can toggle to a polarity opposite to the first polarity. While the voltage on Vcom is toggling, demultiplexer 220 in FIG. 2, for example, can be configured to connect data lines 210 (i.e., Rdata 210, Gdata 210, and Bdata 210) to voltage sources as illustrated in step 504. This may be accomplished by ensuring that all of the switches of demultiplexer 220 are closed when the voltage of Vcom is toggling. Closing these switches can create an electrical connection between the demultiplexer and the red data line, between the demultiplexer and the green data line, and between the demultiplexer and the blue data line. Once these electrical connections are established, each data line can be operatively connected to their voltage sources via demultiplexer 220. These voltage sources can then apply a voltage to each data line to hold the voltage to a fixed value. This fixed voltage is applied to each data line while Vcom toggles as illustrated by the loop between steps 506 and 504. After the voltage on Vcom has finished toggling, demultiplexer 220 can stop the application of the fixed voltage to the data lines by opening its switches in step 508 and can begin controlling these switches in accordance with the write sequence of the next scan line in step 510.

Figure 6:
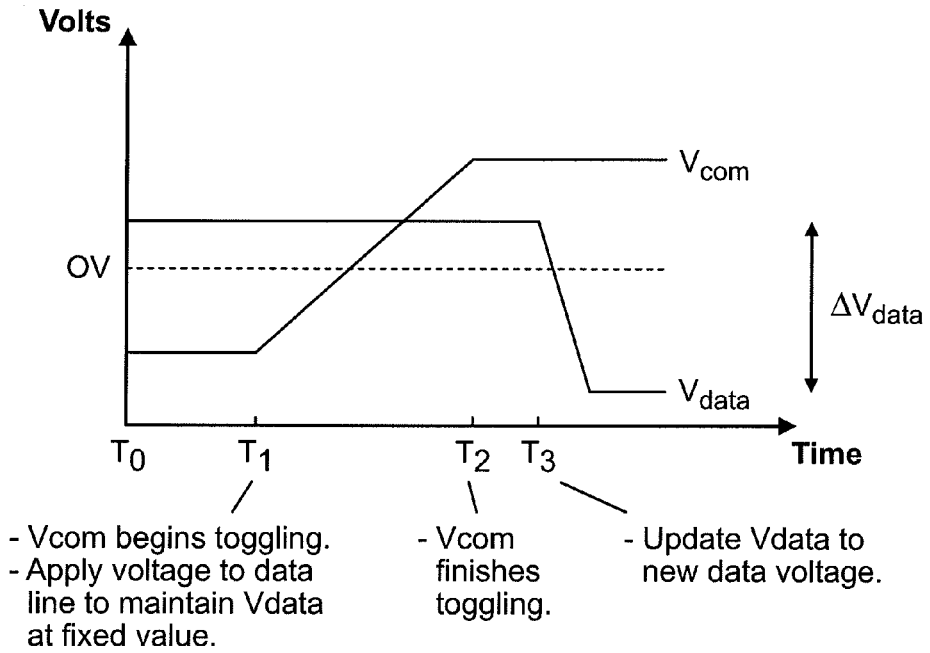
FIG. 6 illustrates the change in voltage on a data line and Vcom when the data line voltages are held at a fixed value when the voltage on Vcom toggles according to embodiments of the disclosure.

FIG. 6 illustrates the effects of holding the voltage on the data line ($V_{data}$) to a fixed value while the voltage on Vcom toggles according to the above example embodiment. As the voltage on Vcom toggles between times T1 and T2, a voltage can be applied to the data line such that $V_{data}$ remains fixed at a predetermined voltage level (e.g., a mid-level gray voltage, ground, etc.). At time T3, data can be written to the data line's corresponding sub-pixel which can drive $V_{data}$ to a negative value. The change in voltage on the data line is represented by $\Delta V_{data}$. If a voltage had not been applied to the data line between times T1 and T2, $V_{data}$ would have increased with the voltage on Vcom, as explained above with respect to FIG. 4, which would have increased $\Delta V_{data}$. By applying a voltage to the data line while the voltage on Vcom toggles, the effect of toggling the Vcom voltage on $\Delta V_{data}$ can be reduced or eliminated.

Figure 7:
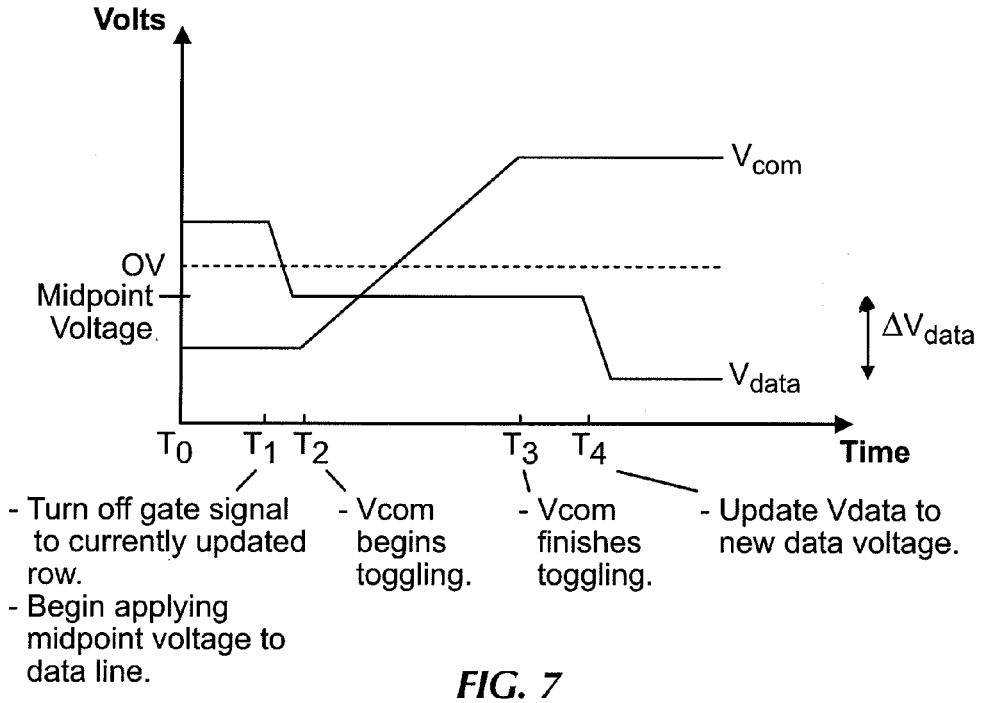
FIG. 7 illustrates the change in voltage on a data line and Vcom when the data line voltages are held at a midpoint voltage when the voltage on Vcom toggles according to embodiments of the disclosure.

With respect to the magnitude of the fixed voltage applied to the data lines while Vcom toggles, a variety of choices may be used. In one example embodiment, this fixed voltage may be any voltage less than a data line's current voltage. In another example embodiment, the midpoint voltage may be applied to the data line as illustrated in FIG. 7. At time T1, the gate signal to the currently updated row's gate line can be turned off, and a midpoint voltage can be applied to the data line. The voltage on the data line can be maintained at this midpoint voltage as Vcom toggles between times T2 and T3 and through time T4. At time T4, data can be written to the data line's corresponding sub-pixel which can drive $V_{data}$ to a negative target value.

The midpoint voltage is a voltage corresponding to a display sub-pixel luminance that is halfway between a minimum luminance and a maximum luminance. By maintaining the voltage on the data line at the midpoint voltage between times T2 and T4, $V_{data}$ will not be affected by the increase in the voltage on Vcom. Moreover, because the midpoint voltage is less than the initial data line voltage, $\Delta V_{data}$ can be smaller when the midpoint voltage is applied than when a voltage equal to the data line's current value is applied. In another example embodiment, zero volts (i.e., ground) may be applied to these data lines while the voltage on Vcom toggles.

Although the above embodiments are described using line inversion schemes, a person of ordinary skill in the art would recognize that other inversion schemes may be used. Moreover, the above embodiments are described in terms of voltages with negative and positive polarities. A person of ordinary skill in the art would understand that this description can apply to other example embodiments wherein all voltages have the same polarity. In these example embodiments, the references to positive and negative polarities can, for example, refer to relatively higher or lower voltage values.

One or more of the functions of the above embodiments including, for example, the application of voltage to the data lines when the voltage on Vcom toggles, can be performed by computer-executable instructions, such as software/firmware, residing in a medium, such as a memory, that can be executed by a processor, as one skilled in the art would understand. The software/firmware can be stored and/or transported within any non-transitory computer-readable storage medium for use by or in connection with an instruction execution system, apparatus, or device, such as a computer-based system, processor-containing system, or other system that can fetch the instructions from the instruction execution system, apparatus, or device and execute the instructions. In the context of this document, a "non-transitory computer-readable storage medium" can be any physical medium that can contain or store the program for use by or in connection with the instruction execution system, apparatus, or device. The non-transitory computer-readable storage medium can include, but is not limited to, an electronic, magnetic, optical, electromagnetic, infrared, or semiconductor system, apparatus or device, a portable computer diskette (magnetic), a random access memory (RAM) (magnetic), a read-only memory (ROM) (magnetic), an erasable programmable read-only memory (EPROM) (magnetic), a portable optical disc such a CD, CD-R, CD-RW, DVD, DVD-R, or DVD-RW, or flash memory such as compact flash cards, secured digital cards, USB memory devices, memory sticks, and the like. In the context of this document, a "non-transitory computer-readable storage medium" does not include signals.

Figure 8:
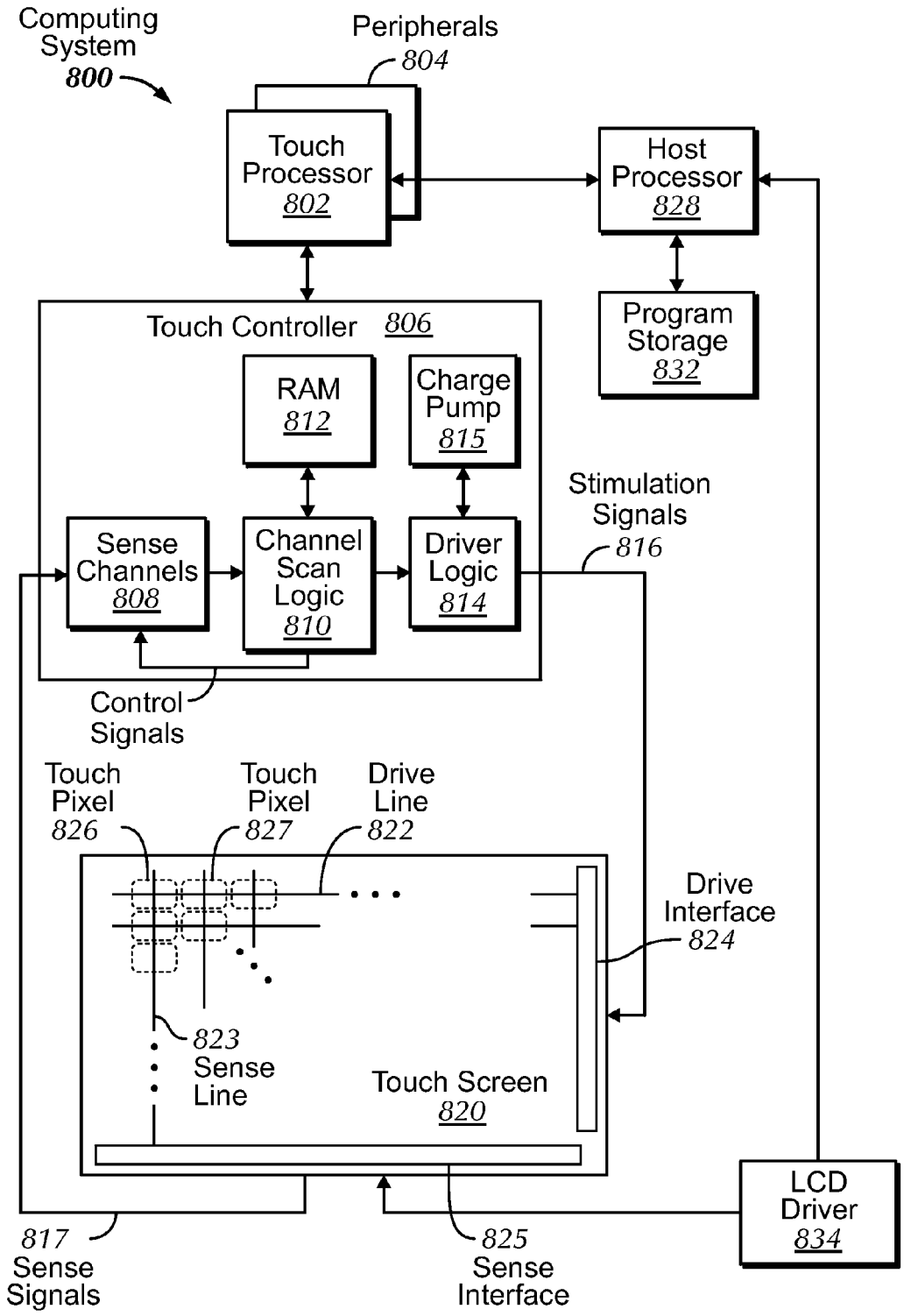
FIG. 8 is a block diagram of an example computing system that illustrates one implementation of an example display screen according to embodiments of the disclosure.

FIG. 8 is a block diagram of an example computing system 800 that illustrates one implementation of an example display screen according to embodiments of the disclosure. In the example of FIG. 8, the computing system is a touch sensing system 800 and the display screen is a touch screen 820, although it should be understood that the touch sensing system is merely one example of a computing system, and that the touch screen is merely one example of a type of display screen. Computing system 800 could be included in, for example, mobile telephone 136, digital media player 140, personal computer 144, or any mobile or non-mobile computing device that includes a touch screen. Computing system 800 can include a touch sensing system including one or more touch processors 802, peripherals 804, a touch controller 806, and touch sensing circuitry (described in more detail below). Peripherals 804 can include, but are not limited to, random access memory (RAM) or other types of memory or non-transitory computer-readable storage media capable of storing program instructions executable by the touch processor 802, watchdog timers and the like. Touch controller 806 can include, but is not limited to, one or more sense channels 808, channel scan logic 810 and driver logic 814. Channel scan logic 810 can access RAM 812, autonomously read data from the sense channels and provide control for the sense channels. In addition, channel scan logic 810 can control driver logic 814 to generate stimulation signals 816 at various frequencies and phases that can be selectively applied to drive regions of the touch sensing circuitry of touch screen 820. In some embodiments, touch controller 806, touch processor 802 and peripherals 804 can be integrated into a single application specific integrated circuit (ASIC). A processor, such as touch processor 802, executing instructions stored in non-transitory computer-readable storage media found in peripherals 804 or RAM 812, can control touch sensing and processing, for example.

Computing system 800 can also include a host processor 828 for receiving outputs from touch processor 802 and performing actions based on the outputs. For example, host processor 828 can be connected to program storage 832 and a display controller, such as an LCD driver 834. Host processor 828 can use LCD driver 834 to generate an image on touch screen 820, such as an image of a user interface (UI), by executing instructions stored in non-transitory computer-readable storage media found in program storage 832, for example, to control the demultiplexers, voltage levels and the timing of the application of voltages as described above to apply a voltage to the data lines while the voltage on Vcom toggles, although in other embodiments the touch processor 802, touch controller 806, or host processor 828 may independently or cooperatively control the demultiplexers, voltage levels and the timing of the application of voltages. Host processor 828 can use touch processor 802 and touch controller 806 to detect and process a touch on or near touch screen 820, such a touch input to the displayed UI. The touch input can be used by computer programs stored in program storage 832 to perform actions that can include, but are not limited to, moving an object such as a cursor or pointer, scrolling or panning, adjusting control settings, opening a file or document, viewing a menu, making a selection, executing instructions, operating a peripheral device connected to the host device, answering a telephone call, placing a telephone call, terminating a telephone call, changing the volume or audio settings, storing information related to telephone communications such as addresses, frequently dialed numbers, received calls, missed calls, logging onto a computer or a computer network, permitting authorized individuals access to restricted areas of the computer or computer network, loading a user profile associated with a user's preferred arrangement of the computer desktop, permitting access to web content, launching a particular program, encrypting or decoding a message, and/or the like. Host processor 828 can also perform additional functions that may not be related to touch processing.

Touch screen 820 can include touch sensing circuitry that can include a capacitive sensing medium having a plurality of drive lines 822 and a plurality of sense lines 823. It should be noted that the term "lines" is sometimes used herein to mean simply conductive pathways, as one skilled in the art will readily understand, and is not limited to elements that are strictly linear, but includes pathways that change direction, and includes pathways of different size, shape, materials, etc. Drive lines 822 can be driven by stimulation signals 816 from driver logic 814 through a drive interface 824, and resulting sense signals 817 generated in sense lines 823 can be transmitted through a sense interface 825 to sense channels 808 (also referred to as an event detection and demodulation circuit) in touch controller 806. In this way, drive lines and sense lines can be part of the touch sensing circuitry that can interact to form capacitive sensing nodes, which can be thought of as touch picture elements (touch pixels), such as touch pixels 826 and 827. This way of understanding can be particularly useful when touch screen 820 is viewed as capturing an "image" of touch. In other words, after touch controller 806 has determined whether a touch has been detected at each touch pixel in the touch screen, the pattern of touch pixels in the touch screen at which a touch occurred can be thought of as an "image" of touch (e.g. a pattern of fingers touching the touch screen).

In some example embodiments, touch screen 820 can be an integrated touch screen in which touch sensing circuit elements of the touch sensing system can be integrated into the display pixels stackups of a display.

Although embodiments of this disclosure have been fully described with reference to the accompanying drawings, it is to be noted that various changes and modifications will become apparent to those skilled in the art. Such changes and modifications are to be understood as being included within the scope of embodiments of this disclosure as defined by the appended claims.

What is claimed is:

1. A method of scanning a display, the display including a plurality of lines of sub-pixels, each sub-pixel being associated with one of a plurality of data lines, the method comprising:

applying a first voltage to a common electrode of the sub-pixels;

scanning a first line of sub-pixels while the first voltage is being applied to the common electrode, wherein scanning the first line includes connecting a first subset of the data lines to one or more voltage sources while remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines;

applying, during a first time period after the scanning of the first line and before a scanning of a second line of sub-pixels, a second voltage to the common electrode, wherein the second voltage is different than the first voltage;

connecting, during the first time period, the plurality of data lines to the one or more voltage sources, such that the data lines are connected to the one or more voltage sources concurrently with the second voltage being applied to the common electrode;

applying, during the first time period, one or more fixed voltages to the data lines; and scanning the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein the one or more fixed voltages includes a mid-level gray voltage.

2. The method of claim 1, wherein the polarity of the second voltage is different that the polarity of the first voltage.

3. The method of claim 1, wherein, during the first time period, the plurality of data lines are connected to the one or more voltage sources before the second voltage is applied to the common electrode.

4. The method of claim 1, wherein the scanning of the first and second lines occurs during the scanning of a single frame of the display.

5. A method of scanning a display, the display including a plurality of lines of sub-pixels, each sub-pixel being associated with one of a plurality of data lines, the method comprising:

applying a first voltage to a common electrode of the sub-pixels;

scanning a first line of sub-pixels while the first voltage is being applied to the common electrode, wherein scanning the first line includes connecting a first subset of the data lines to one or more voltage sources while remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines;

applying, during a first time period after the scanning of the first line and before a scanning of a second line of sub-pixels, a second voltage to the common electrode, wherein the second voltage is different than the first voltage;

connecting, during the first time period, the plurality of data lines to the one or more voltage sources, such that the data lines are connected to the one or more voltage sources concurrently with the second voltage being applied to the common electrode;

applying, during the first time period, one or more fixed voltages to the data lines; and scanning the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein connecting, during the first time period, the plurality of data lines to the one or more voltage sources includes connecting two of the data lines to the same voltage source, wherein each set of a plurality of sets of three adjacent data lines is associated with a display pixel in each line of sub-pixels, and wherein connecting, during the first time period, the plurality of data lines to the one or more voltage sources includes connecting the data lines in each set of data lines to the same voltage source, and wherein the connecting, during the first time period, the plurality of data lines to the one or more voltage sources further includes connecting each of the sets of three data lines to a different voltage source than each of the other sets.

6. A method of scanning a display, the display including a plurality of lines of sub-pixels, each sub-pixel being associated with one of a plurality of data lines, the method comprising:

applying a first voltage to a common electrode of the sub-pixels;

scanning a first line of sub-pixels while the first voltage is being applied to the common electrode, wherein scanning the first line includes connecting a first subset of the data lines to one or more voltage sources while remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines;

applying, during a first time period after the scanning of the first line and before a scanning of a second line of sub-pixels, a second voltage to the common electrode, wherein the second voltage is different than the first voltage;

connecting, during the first time period, the plurality of data lines to the one or more voltage sources, such that the data lines are connected to the one or more voltage sources concurrently with the second voltage being applied to the common electrode;

applying, during the first time period, one or more fixed voltages to the data lines; and scanning the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein the one or more fixed voltages includes voltages with magnitudes less than voltages applied to the data lines during the scanning of the first line.

7. An apparatus comprising:

a display screen including a plurality of lines of sub-pixels, each sub-pixel being associated with one of a plurality of data lines; and a display driver, the display driver configured to apply a first voltage to a common electrode of the sub-pixels, scan a first line of sub-pixels while the first voltage is being applied to the common electrode, wherein scanning the first line includes connecting a first subset of the data lines to one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, apply, during a first time period after the scanning of the first line and before a scanning of a second line of sub-pixels, a second voltage to the common electrode, wherein the second voltage is different than the first voltage, connect, during the first time period, the plurality of data lines to the one or more voltage sources, such that the data lines are connected to the one or more voltage sources concurrently with the second voltage being applied to the common electrode, apply, during the first time period, one or more fixed voltages to the data lines, and scan the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein the one or more fixed voltages includes a mid-level gray voltage.

8. The apparatus of claim 7, wherein the polarity of the second voltage is different that the polarity of the first voltage.

9. The apparatus of claim 7, wherein, during the first time period, the plurality of data lines are connected to the one or more voltage sources before the second voltage is applied to the common electrode.

10. The apparatus of claim 7, wherein the scanning of the first and second lines occurs during the scanning of a single frame of the display.

11. An apparatus comprising:

a display screen including a plurality of lines of sub-pixels, each sub-pixel being associated with one of a plurality of data lines;

a display driver, the display driver configured to apply a first voltage to a common electrode of the sub-pixels, scan a first line of sub-pixels while the first voltage is being applied to the common electrode, wherein scanning the first line includes connecting a first subset of the data lines to one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, apply, during a first time period after the scanning of the first line and before a scanning of a second line of sub-pixels, a second voltage to the common electrode, wherein the second voltage is different than the first voltage, connect, during the first time period, the plurality of data lines to the one or more voltage sources, such that the data lines are connected to the one or more voltage sources concurrently with the second voltage being applied to the common electrode, apply, during the first time period, one or more fixed voltages to the data lines, and scan the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein connecting, during the first time period, the plurality of data lines to the one or more voltage sources includes connecting two of the data lines to the same voltage source; and a plurality of demultiplexers, each demultiplexer associated with one of a plurality of sets of three adjacent data lines, each set being associated with a display pixel in each line of sub-pixels, and wherein connecting, during the first time period, the plurality of data lines to the one or more voltage sources includes closing switches in each demultiplexer to connect the data lines in each set of data lines to the same voltage source, wherein each demultiplexer is connected to a different voltage source, such that connecting, during the first time period, the plurality of data lines to the one or more voltage sources further includes connecting each of the sets of three data lines to a different voltage source than each of the other sets.

12. An apparatus comprising:

a display screen including a plurality of lines of sub-pixels, each sub-pixel being associated with one of a plurality of data lines; and a display driver, the display driver configured to apply a first voltage to a common electrode of the sub-pixels, scan a first line of sub-pixels while the first voltage is being applied to the common electrode, wherein scanning the first line includes connecting a first subset of the data lines to one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, apply, during a first time period after the scanning of the first line and before a scanning of a second line of sub-pixels, a second voltage to the common electrode, wherein the second voltage is different than the first voltage, connect, during the first time period, the plurality of data lines to the one or more voltage sources, such that the data lines are connected to the one or more voltage sources concurrently with the second voltage being applied to the common electrode, apply, during the first time period, one or more fixed voltages to the data lines, and scan the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein the one or more fixed voltages includes voltages with magnitudes less than voltages applied to the data lines during the scanning of the first line.

13. A non-transitory computer-readable storage medium storing computer-readable program instructions executable to perform a method of scanning a display, the display including a plurality of lines of sub-pixels, each sub-pixel being associated with one of a plurality of data lines, the method comprising:

applying a first voltage to a common electrode of the sub-pixels;

scanning a first line of sub-pixels while the first voltage is being applied to the common electrode, wherein scanning the first line includes connecting a first subset of the data lines to one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines;

applying, during a first time period after the scanning of the first line and before a scanning of a second line of sub-pixels, a second voltage to the common electrode, wherein the second voltage is different than the first voltage;

connecting, during the first time period, the plurality of data lines to the one or more voltage sources, such that the data lines are connected to the one or more voltage sources concurrently with the second voltage being applied to the common electrode;

applying, during the first time period, one or more fixed voltages to the data lines; and scanning the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein the one or more fixed voltages includes a mid-level gray voltage.

14. The non-transitory computer-readable storage medium of claim 13, wherein the polarity of the second voltage is different that the polarity of the first voltage.

15. The non-transitory computer-readable storage medium of claim 13, wherein, during the first time period, the plurality of data lines are connected to the one or more voltage sources before the second voltage is applied to the common electrode.

16. The non-transitory computer-readable storage medium of claim 13, wherein connecting, during the first time period, the plurality of data lines to the one or more voltage sources includes connecting two of the data lines to the same voltage source.

17. The non-transitory computer-readable storage medium of claim 13, wherein the scanning of the first and second lines occurs during the scanning of a single frame of the display.

18. A non-transitory computer-readable storage medium storing computer-readable program instructions executable to perform a method of scanning a display, the display including a plurality of lines of sub-pixels, each sub-pixel being associated with one of a plurality of data lines, the method comprising:

applying a first voltage to a common electrode of the sub-pixels;

scanning a first line of sub-pixels while the first voltage is being applied to the common electrode, wherein scanning the first line includes connecting a first subset of the data lines to one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines;

applying, during a first time period after the scanning of the first line and before a scanning of a second line of sub-pixels, a second voltage to the common electrode, wherein the second voltage is different than the first voltage;

connecting, during the first time period, the plurality of data lines to the one or more voltage sources, such that the data lines are connected to the one or more voltage sources concurrently with the second voltage being applied to the common electrode;

applying, during the first time period, one or more fixed voltages to the data lines; and scanning the second line of sub-pixels while the second voltage is being applied to the common electrode, wherein scanning the second line includes connecting the first subset of the data lines to the one or more voltage sources while the remaining data lines are disconnected from the one or more voltage sources, applying data voltages to the first subset of data lines, disconnecting the first subset of data lines from the one or more voltage sources, connecting a second subset of the data lines to the one or more voltage sources, and applying data voltages to the second subset of data lines, wherein the one or more fixed voltages includes voltages with magnitudes less than voltages applied to the data lines during the scanning of the first line.

* * * * *